United States Patent [19]

Yasuda et al.

[11] Patent Number: 4,824,752

[45] Date of Patent: Apr. 25, 1989

[54] ELECTROPHOTOGRAPHIC MAGNETIC DRY DEVELOPER CONTAINING CERIUM OXIDE AND HYDROPHOBIC SILICA

[75] Inventors: Satoshi Yasuda, Matsudo; Mitsuru Uchida, Chofu; Seiichi Takagi, Yokohama; Yusuke Karami, Kamakura, all of Japan

[73] Assignee: Canon Kabushiki Kaisha, Tokyo, Japan

[21] Appl. No.: 243,220

[22] Filed: Sep. 12, 1988

Related U.S. Application Data

[63] Continuation of Ser. No. 857,023, Apr. 29, 1986, abandoned.

[30] Foreign Application Priority Data

Nov. 19, 1985 [JP] Japan ..... 60-260597
Dec. 23, 1985 [JP] Japan ..... 60-291165

[51] Int. Cl.[4] ..... G03G 9/14

[52] U.S. Cl. ..... 430/106.6; 430/903; 430/110

[58] Field of Search ..... 430/106.6, 903, 110

[56] References Cited

U.S. PATENT DOCUMENTS

| | | | |
|---|---|---|---|
| 3,547,822 | 12/1970 | Miller | 430/106.6 |
| 3,826,747 | 7/1974 | Nagashima et al. | 430/110 |
| 3,926,824 | 12/1975 | Lipani et al. | 430/109 |
| 4,108,786 | 8/1978 | Takayama | 430/903 |
| 4,245,022 | 1/1981 | Sadamatsu | 430/110 |
| 4,535,048 | 8/1985 | Inoue et al. | 430/110 |
| 4,626,487 | 12/1986 | Mitsuhashi | 430/109 |

FOREIGN PATENT DOCUMENTS

| | | |
|---|---|---|
| 0127375 | 12/1984 | European Pat. Off. . |
| 2324378 | 12/1973 | Fed. Rep. of Germany . |
| 3329252 | 2/1984 | Fed. Rep. of Germany . |
| 2067777 | 7/1981 | United Kingdom . |

*Primary Examiner*—J. David Welsh
*Attorney, Agent, or Firm*—Fitzpatrick, Cella, Harper & Scinto

[57] ABSTRACT

A magnetic dry developer, comprising negatively chargeable insulating magnetic toner particles containing, at least, a binder resin, a magnetic substance, and an organo-chromium or -zinc complex; cerium oxide particles containing $CeO_2$ as a predominant component and having a volume average particle size of 1.0 to 4.0 microns, a heating loss of 0.5 wt. % or less on heating up to 100° C. and a BET specific surface area of 15 $m^2/g$ or less as measured by the nitrogen adsorption method; and hydrophobicity-imparted negatively chargeable silicon oxide particulates. The cerium oxide particles have a function of disintegrating particularly the hydrophobicity-imparted silicon oxide particulates and enhance the attachment thereof to the toner particles, whereby the developing characteristics including the magnetic triboelectric chargeability are stabilized from the initial stage of electrophotographic copying operation.

18 Claims, 2 Drawing Sheets

ELECTROPHOTOGRAPHIC MAGNETIC DRY DEVELOPER CONTAINING CERIUM OXIDE AND HYDROPHOBIC SILICA

This appliction is a continuation of application Ser. No. 857,023 filed Apr. 29, 1986, now abandoned.

FIELD OF THE INVENTION AND RELATED ART

The present invention relates to an insulating magnetic dry developer for developing latent images in electrophotography, electrostatic recording and electrostatic printing, and more particularly to an insulating magnetic dry developer for use in a developing process for direct or indirect electrophotography, which comprises, at least, a uniformly and strongly negatively chargeable toner, a negatively chargeable hydrophobic silica, and specific cerium oxide particles.

Hitherto, a large number of electrophotographic processes have been known as disclosed in U.S. Pat. Nos. 2,297,691; 3,666,362 (Japanese Patent Publication No. 23910/67) and 4,071,361 (Japanese Patent Publication No. 24748/68). In such conventional processes, a latent image is formed by uniformly charging a photoconductive layer and exposing it with light image corresponding to an original so as to cause the extinction of the charge at the exposed portion. A fine powdery electroscopic material, so-called "toner" is attached to the resulting electrostatic latent image to effect the development. The toner is attracted to the electrostatic latent image depending on the amount of charge on the photoconductive layer to form a toner image having varying densities. This toner image is transferred onto the surface of a support such as paper, as desired, and then permanently fixed thereon by fixing means such as heating, pressing or heating and pressing rollers. If the toner image transferring step is desired to be omitted, then the toner image can be fixed on the photoconductive layer. Alternatively, instead of such fixing means, it is possible to employ another means such as solvent treatment or overcoating.

A large number of developing methods in electrophotography are known and among others, there have been widely carried out a cascade developing method as described in U.S. Pat. No. 2,618,552 and a magnetic brush method as described in U.S. Pat. No. 2,874,063 which use a two-component developer prepared by mixing a toner with a carrier. These methods are both excellent and provide a relatively stable and good image. However, they are accompanied by common problems associated with a two-component developer, such as the deterioration of the carrier and the variation in mixing ratio of toner to carrier. To avoid these problems, various developing methods have been proposed which employ an one-component developer consisting of a toner but free of a carrier. Among them, a developing method using a magnetic toner having an electric conductivity is proposed in U.S. Pat. No. 3,909,258 as a method using a developer consisting of toner particles having a magnetism. This developing method involves supporting a conductive magnetic developer on a cylindrical conductive toner carrier (sleeve) internally having a magnetic and bringing the supported developer into contact with an electrostatic image. In this case, in a developing vessel, the toner particles provide a conductive path between the surface of a recording medium and the surface of the sleeve, so that a charge is passed from the sleeve through such a path to the toner particles. A Coulomb force between the image portion of the electrostatic image and the toner particles causes the toner particles to be deposited onto the image portion to effect development. This developing method using the conductive magnetic toner is one which has avoided the problems associated with the conventional twocomponent system developing method. However, this method has a problem, in that because the toner has a conductivity, it is difficult to electrostatically transfer the developed image from the recording medium onto a final support member such as plain paper.

For this reason, there has been proposed a developing method using an electrostatically transferable magnetic toner having a high electric resistance of $10^{10}$ Ωcm or more or an insulating property. For example, U.S. Pat. No. 4,336,318 discloses a developing method employing a magnetic toner having an electrically insulating property. G.B. Patent No. 1,503,560 discloses a method for developing an electrostatic latent image with a magnetic toner, containing an exposed magnetic substance, charged by mutual friction. In the developing methods using an insulating magnetic developer free of carrier particles, a triboelectric charge is applied to the toner particles by the friction between the toner particles and toner carrier (developing sleeve) and/or between the toner particles. With the use of a two-component developer containing a carrier, it is possible to provide a satisfactory triboelectric charge for the toner particles through frequent frictional contact of the toner particles with a considerably large amount of a carrier and by the stirring effect of the carrier. However, with a one-component developer, it is difficult to provide a triboelectric charge as high as that with the twocomponent developer. For this reason, a charge controller is incorporated in the toner particles.

These one-component developers are apt to aggregate within a developing vessel because of the absence of carrier particles which also serve to stir the toner as in the two-component developer, and therefore, a fluidizing agent such as silicon oxide particulates is added thereto as an external additive. When the fluidizing agent is of silicon oxide particulates, the particulates themselves have a negative chargeability and hence, may serve as an auxiliary for a good charge retention for the negatively chargeable toner. Because the toner has a negative charge and the silicon oxide particulates also have the same negative charge, however, electrostatic repulsion operates, making it difficult for the silicon oxide particulates to attach to the toner particles. This has been a cause for significant decrease or falling-down in image density in the initial stage of operation of a copier.

SUMMARY OF THE INVENTION

It is an object of the present invention to provide a magnetic developer which overcomes the falling-down in image density found in the conventional one-component developer containing a negatively chargeable insulating magnetic toner.

It is another object of the present invention to provide a magnetic developer which is capable of forming a copied image having a higher image density.

It is a further object of the present invention to provide a magnetic developer which is hardly affected by change in environmental conditions.

It is a yet further object of the present invention to provide a magnetic developer wherein a film causing an image flow and an image disturbance to be produced is not readily formed on the surface of a latent image-carrying member.

According to the present invention, there is provided a magnetic dry developer comprising negatively chargeable insulating magnetic toner particles containing, at least, a binder resin, a magnetic substance and an organo-chromium or -zinc complex; cerium oxide particles comprising $CeO_2$ as a predominant component and having a volume-average particle size of 1 to 4 microns, a loss in heating up to 100° C. of 0.5 wt. % or less and a BET specific surface area of 15 $m^2/g$ or less as determined by nitrogen gas adsorption measurement; and negatively chargeable hydrophobicity-imparted silicon oxide particulates.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
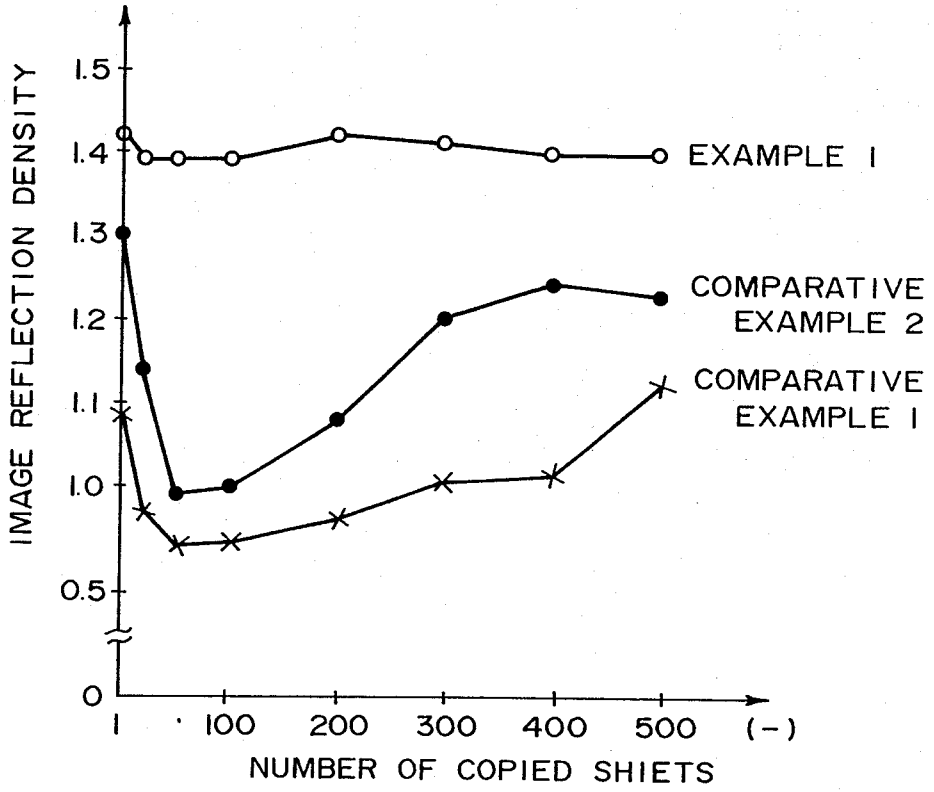
FIGS. 1 and 2 are graphs illustrating a relationship between the number of copied sheets and the image reflection density for developers in Examples 1 and 2, Comparative Examples 1, 2, 8 and 9.

In the present invention, an organo-chromium or -zinc complex is dispersed in a binder resin for the purpose of improving the negatively chargeable characteristic of an insulating magnetic toner. The organo-chromium complex used in the present invention has a negative chargeability controlling property, and examples thereof include chromium complex salt-type monoazo dyes, and chromium complexes of salicylic acid, alkylsalicylic acids and dialkylsalicylic acids, which are used alone or in combination of two or more of them. The alkyl group of the alkylsalicylic acid or dialkylsalicylic acid may have 1 to 8, preferably 3 to 5, carbon atoms. Usually, in view of a blocking property and an anti-offsetting property, the organochromium complex is added in an amount of 0.1 to 10 wt. %, preferably 0.5 to 5 wt. %, based on the weight of the binder resin. Specific examples of the organochromium complexes are the followings:

(A) Chromium complex salt-type monoazo dyes:
- Spiron Black BHH (available from Hodogaya Kagaku K.K.);
- Spiron Black TRH (available from Hodogaya Kagaku K.K.);
- Bontron S-34 (available from Orient Kagaku K.K.);
- Bontron S-36 (available from Orient Kagaku K.K.);
- Vari Fast Black +3804 (available from Orient Kagaku K.K.); and
- Zspon Fast Black Ge (available from BASF, A.G.).

(B) Chromium salicylic, alkylsalicylic and dialkylsalicylic complexes:
- Bontron E-81 (available from Orient Kagaku K.K.); and
- Bontron E-82 (available from Orient Kagaku K.K.).

The organo-zinc complexes which may be used in the present invention include zinc complex salt-type monoazo dyes and the zinc complexes of salicylic or alkylsalicylic acids. They are used alone or in combination of two or more thereof. In view of a blocking property and an anti-offsetting property, they are added in an amount of 0.1 to 10 wt. %, preferably 0.5 to 5 wt. %, based on the weight of the binder resin.

The organo-zinc complexes include zinc acetylacetone complex, zinc EDTA complex and zinc picolinic complex.

A negatively chargeable insulating magnetic toner containing an organo-chromium or -zinc complex added therein provides an improvement in triboelectric chargeability through friction, but on the other hand, presents a tendency of reducing flowability due to the occurrence of aggregation, and therefore, in the present invention, hydrophobicity-imparted silicon oxide particulates are added as a fluidizing agent in a developer. The hydrophobicity-imparted silicon oxide particulates provides a flowability to the toner particles and assists in the negative chargeability, and further, also serves as an abrasive in a cleaning step.

The hydrophobicity-imparted silicon oxide particulates are those which have been subjected to a surface treatment with a silane coupling agent or a silicone oil so as to have a hydrophobicity and which have an excellent moisture-resistance.

Preferably used as the hydrophobicity-imparted silicon oxide particulates which may preferably be used in the present invention are those having a primary number-average particle size of 0.5 micron or less and a secondary number-average particle size of 3 microns or less as measured by observation of 20 particles thereof selected at random through an electron microscope for determination of the average particle size. A method for producing the silicon oxide particulates may be of dry- or wet-type, but those produced in the dry method is preferred in view of physical properties.

The hydrophobicity-imparted silicon oxide particulates used are preferably those having a methanol hydrophobicity of 40% or higher as measured by a methanol titration test. A typical example of fine siliceous particulates to be modified in hydrophobicity is anhydrous silicon dioxide (silica). Other siliceous compounds can also be used, inclusive of aluminum silicate, sodium silicate, potassium silicate, magnesium silicate and zinc silicate after hydrophobicity modification. The hydrophobicityimparted silicon oxide particulates are incorporated in an amount of 0.01 to 3 wt. parts, preferably 0.1 to 2 wt. parts, per 100 parts of the magnetic toner.

Examples of agents (organo-silicon compounds) used for surface hydrophobicity-modification include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, organosilylmercaptane, trimethylsilylmercaptane, triorganosilylacrylate, vinyldimethylacetoxysilane, dimethylethoxysilane, dimethyldimethoxysilane, diphenyldiethoxysilane, hexylmethyldisiloxane, 1,3-divinyltetramethyldisiloxane, 1,3-diphenyltetramethyldisiloxane, 1,3-diphenyltetramethyldisiloxane, and dimethyl polysiloxanes containing 2 to 12 siloxane units per molecule and up to one hydroxy group on each terminal unit. They are used alone or in a mixture of two or more thereof. Examples of commercially available hydrophobicity-imparted silicon oxide particulates (hydrophobic silica) include R-972, R-974, R-976, RY-130, RY-200, RY-300 and R-812 available from Aerosil Co.; and T-340 and T-500 available from Talco Co.

It is preferred that the hydrophobicity of hydrophobic silica, i.e., hydrophobicity-imparted silicon oxide particulates, is increased so as to show a value of 40% or more as measured by the methanol titration test, because a developer containing the fine powder of such silica will exhibit a sharp and uniform negative triboelectric charge. The methanol titration test provides a measure of hydrophobicity of the fine silica powder having a hydrophobicity-imparted surface. The "methanol titration test" used in the present invention for evaluating the hydrophobicity-imparted silica powder for hydrophobicity is carried out as follows. A fine silica powder to be tested is added into 50 ml of water in a 250 ml-Erlenmeyer flask. Methanol is dropped from a buret until the silica is wetted, thus effecting the titration. During this period, the solution in the flask is continually stirred by a magnet stirrer. The end point is determined by visually observing the entire quantity of the silica powder suspended in the liquid. The hydrophobicity is represented by the percentage of methanol in a liquid methanol/water mixture at the time when the end point has been reached.

An insulating magnetic toner having a negative changeability enhanced by the addition of an organochlomium or -zinc complex shows a marked tendency that the silicon particulates are not readily attached thereto due to the electrostatic repulsion of the toner against the silicon particulates. For this reason, specific cerium oxide particles are incorporated in the developer according to the present invention as an additive for overcoming the electrostatic repulsion against the hydrophobicity-imparted silicon oxide particulates so that they are rapidly attached to the toner.

For the cerium oxide particles containing $CeO_2$ as a predominant constituent and forming one component of the developer in the present invention, use is made of those having a volume average particle size of 1.0 to 4.0 microns (preferably, 1.5 to 3.5 microns) as measured by means of an Elzone counter, a specific surface area of 15 $m^2/g$ or less as determined in the BET method, and a heating loss of 0.5 wt. % or less on heating up to 100° C. after being left to stand for 72 hours in an atmosphere of a relative humidity of 90% or more.

The measurement for the volume-average particle size in the present invention is conducted by an Elzone counter using a 24 microns-orifice. The Elzone counter is similar in principle to the Coulter counter, but enables a more accurate measurement for a distribution of fine particle sizes as small as in a range of from a submicron to 5 microns by using an increased number of divided channels and a smaller diameter orifice. The measurement for the specific surface area by the BET method in the present invention is carried out by using an automatic specific surface area measuring device, wherein nitrogen gas ($N_2$) is adsorbed on a powder sample to determine a specific area from the changes in the amount of gas and in the weight of the sample.

The measurement for the heating loss on heating up to 100° C. in the present invention can be accomplished by using, as a sample, about 50% of the cerium oxide particles which have been left to stand for 72 hours in a desicator (a temperature of 20° C. and a relative humidity of 90% or more) in which the moisture was adjusted with a saturated ammonium chloride solution and employing, for example, a differential thermal balance (DTA-TG, available from Rigaku Denki K.K.) without the use of a carrier gas.

The cerium oxide used in the present invention contains $CeO_2$ as a predominant constituent and serves as an abrasive. The cerium oxide particles are mixed in an amount of 0.1 to 5 wt. parts per 100 wt. parts of the magnetic toner. It should be noted that if the content of $CeO_2$ is lower than 50 wt. %, the ability as an abrasive is reduced in a cleaning step.

Commercially available examples of the cerium oxide include the following:

Mirek T (Mitsui Kinzoku Kogyo K.K.);
Mirek (Mitsui Kinzoku Kogyo K.K.);
ROX M-1 (Tohoku Kinzoku Kagaku K.K.); and
ROX M-3 (Tohoku Kinzoku Kagaku K.K.).

The cerium oxide particles used in the present invention have a volume-average particle size of 1 to 4 microns as described above. With the use of the cerium oxide particles having a volume-average particle size smaller than 1 micron, aggregation of the cerium oxide particles occurs to hinder the movement as free particles, resulting in a reduced stirring ability. With the use of the cerium oxide particles having a volume-average particle size larger than 4 microns, the difference from the particle size of the hydrophobic silicon oxide particulates becomes pronounced, thus causing decrease in the abilities of disintegrating and stirring the aggregates of the silica particulates. This results in a reduced ability of suppressing the decrease and the fallingdown of the initial image density. With the cerium oxide particles having a heating loss and a BET specific surface area outside the range defined in the present invention, the inherent flowability and moistureresistance of the cerium oxide are inferior, so that the operation of the cerium oxide particles contemplated by the present invention is reduced. By adding particular cerium oxide particles into a mixture of negatively chargeable insulating toner containing an organo-chromium or -zinc complex and the hydrophobicity-imparted silicon oxide particulates, these silicon oxide particulates present a strong negative chargeability and satisfactorily serve both as a fluidizing agent and as a charging agent for the negatively chargeable insulating magnetic toner. This is also presumed from the fact that the addition of the hydrophobicity-modified silicon oxide particulates into the developer causes the density to considerably increase as compared with the developer free of them.

Even at the initial stage of the development, stirring of the hydrophobicity-imparted silicon oxide particulates and the toner is sufficiently effected, so that good dispersion of the hydrophobicity-imparted silicon oxide particulates in the toner particles is ensured. This provides an increased initial image density and suppresses the falling-down in initial density. Upon observation through a microscope, much aggregated toner mass and the aggregates of the silicon oxide particulates are found in a developer free of the cerium oxide particles, while such aggregates are not found or otherwise are merely present in an extremely small amount, if any, in a developer containing the silicon oxide particles. It can be understood from the latter developer exhibiting an extremely good flowability that the cerium oxide particles have a function of satisfactorily dispersing the fine powder of silicon oxide in the toner. In fact, from the observation of the surfaces of the toners respectively with and without the cerium oxide particles, it is seen that the quantity of the silicon oxide particulates deposited on or attached to the toner and the deposition states thereof are substantially different between the above two cases and that in the developer containing the cerium oxide particles, the fine silicon oxide powder present on the toner surface is extremely finely dispersed and evenly deposited on the toner surface, whereas in the developer not containing the cerium oxide particles, the silicon oxide particulates are unevenly present in a form close to aggregates on a part of the toner surface. From the fact that in the developer containing the cerium oxide particles, there are found cerium oxide particles having silicon oxide particulates deposited thereon in the neighborhood of cerium oxide particles, it is presumed that the cerium oxide particles disintegrate and disperse such aggregates of silicon oxide particulates and further behave as carriers for the silicon oxide particulates to supply the silicon oxide particulates to the toner. Therefore, in a system comprising a negatively chargeable toner and negatively chargeable silicon oxide particulates, the silicon oxide particulates are considered to act particularly on the negatively chargeable silicon oxide particulates to disintegrate the aggregation thereof and to rapidly supply the negatively chargeable and hydrophobicity-imparted silicon oxide particulates to the negatively chargeable toner. It is supposed that the selective action of the cerium oxide particles on the silicon oxide particulates rather than the toner is probably because the silicon oxide particulates have a potentially higher negative chargeability that the toner, while at the same time, the particle size of the silicon oxide particulates are closer to that of the cerium oxide particles than to that of the toner.

When a mixture of a negatively chargeable toner and negatively chargeable silicon oxide is left to stand over a long period, they are liable to be separated from each other and to cause agglomeration so that the developer characteristics deteriorate. To improve this, the toner and the silicon oxide particulates must be stirred and mixed again, and with those already left to stand within the developing apparatus, the gradual regeneration thereof by the stirring device within the developing apparatus must be waited. On the contrary, with the developer containing specific cerium oxide particles according to the present invention, the silicon oxide particulates are rapidly provided to the negatively chargeable toner in cooperation of such a stirring device with the cerium oxide particlcs, and therefore, deterioration of the developer characteristics is little found. These phenomena are in agreement with the function of the cerium oxide particles as explained above.

The toner binder resin used in the present invention may be known ones. Examples of such binder resins are homopolymers of styrene and substituted styrene, such as polystyrene, poly-p-chlorostyrene and polyvinyl toluene; styrene copolymers such as styrene/p-chlorostyrene copolymer, styrene/propylene copolymer, styrene/vinyltoluene copolymer, styrene/vinylnaphthalene copolymer, styrene/methyl acrylate copolymer, styrene/ethyl acrylate copolymer, styrene/butyl acrylate copolymer, styrene/2-ethylhexyl acrylate copolymer, styrene/octyl acrylate copolymer, styrene/methyl methacrylate copolymer, styrene/ethyl methacrylate copolymer, styrene/butyl methacrylate copolymer, styrene/methyl α-chloromethacrylate copolymer, styrene/acrylonitrile copolymer, styrene/vinyl methyl ether copolymer, styrene/vinyl ethyl ether copolymer, styrene/vinyl methyl ketone copolymer, styrene/butadiene copolymer, styrene/acrylnitrile/indene terpolymer, styrene/maleic acid copolymer, styrene/maleic half-ester copolymer, and styrene/maleic ester copolymer; polymethyl methacrylate, polybutyl methacrylate, polyvinyl chloride, polyvinyl acetate, polyethylene, polypropylene, polyesters, polyurethanes, epoxy resins, polyvinyl butyral, polyamides, polyacrylic resins, rosin, modified rosins, terpene resin, phenolic resins, aliphatic or alicyclic hydrocarbon resins, organic petroleum resins, chlorinated paraffin, paraffin, and wax. These binder resins can be used alone or in combination.

Among others, styrene resins, styrene/acrylic ester resins, styrene/methacrylic ester resins and polyesters are preferred in respect of developing property and durability.

For the particle size of a magnetic toner made by incorporating a magnetic substance into such a binder resin and granulating the resulting mixture, a volume average particle size of 5 to 30 microns is preferred. It is desirable for the negatively chargeable insulating toner according to the present invention to have an electric resistance of $10^{10}$ Ωcm or more, preferably, $10^{13}$ Ωcm or more, in order to retain a triboelectric charge and have a satisfactory developing characteristic and a satisfactory electrostatic transfer characteristic.

The magnetic substances contained in the toner which can be used, include alloys and compounds of iron, cobalt, nickel and manganese, such as magnetite, hematite and ferrite, and other ferromagnetic alloys.

The particle size of the magnetic substance may be 100 to 800 mμ, preferably 300 to 500 mμ, and the content of the magnetic substance may be preferably 30 to 100 wt. parts, more preferably 40 to 90 wt. parts, based on 100 wt. parts of the binder resin.

Further, in the magnetic toner according to the present invention, it is desirable for enhancement of anti-offsetting property to add 0.1 to 10 wt. parts, preferably 0.5 to 8 wt. parts, of an anti-offsetting agent such as lower molecular weight polypropylene, per 100 parts of the binder resin.

In the production of a toner according to the present invention, the following processes can be applied: a process comprising thoroughly kneading components in a hot kneading machine such as a kneader or an extruder, cooling the kneaded mixture, and then mechanically pulverizing it and classifying the pulverized mixture to give a toner; a process comprising dispersing a component such as magnetic powder into a solution of a binder resin and spray-drying the resulting mixture to give a toner; and a process comprising mixing desired components with a monomer providing a binder resin, and then polymerizing the resulting emulsion or suspension to obtain a toner.

Recently, there has been proposed a microencapsulated toner for the purpose of separating the functions of the toner, and the present invention is applicable to such a micro-encapsulated toner, so long as the requirements of the present invention are satisfied.

To mix the above-described inorganic fine powder with the toner, use can be made of, for example, a rotary vessel-type mixer such as a V-shaped mixer and a Turbula mixer, and a stationary vessel-type mixer such as a ribbon-type, a screw-type and a rotary brade-type.

The essential components of the toner according to the present invention may be mixed at one time or sequentially in view of the properties of the toner. It is also possible to additionally mix another optional component. For example, such an optional component may be an additive such as polyethylene fluoride, polyvinylidene fluoride, a metal salt of a fatty acid, and various abrasives.

The present invention will now be described in more detail by way of Examples and Comparative Examples which should not be construed to limit the present invention in any way.

EXAMPLE 1

| | |
|---|---|
| Styrene-n-butyl methacrylate copolymer (weight ratio of styrene to n-butyl methacrylate of 6:4; Mw = 230,000) | 100 wt. parts |
| Magnetite (volume average particle size of 0.5 micron) | 60 wt. parts |
| Lower molecular weight polyethylene | 4 wt. parts |
| Cr complex monoazo dye (Bontron S-34) | 2 wt. parts |

A mixture having the above prescription was melt-kneaded, cooled and then pulverized and classified to give an insulating magnetic toner (an electric resistance of $10^{15}$ Ωcm) having a particle size of 5 to 20 microns (a volume average particle size of 12 microns). Then, 100 wt. parts of the resulting insulating magnetic toner was mixed with 0.4 wt. part of a hydrophobic silica having a hydrophobicity of about 65 and an average primary particle size of 0.007 micron and one part of cerium oxide particles containing 80 wt. % of $CeO_2$ (a volume-average particle size of 2.74 microns as measured by an Elzone counter (available from Particle Data, Co., U.S.A.); a heating loss of 0.14 wt. % on heating up to 100° C. after humidification; and a BET specific surface area of 3.6 $m^2/g$ as measured by an automatic specific surface area measuring device (2200-type, available from Shimazu Seisakusho K.K.)) to prepare a developer.

The developer was applied to a commercially available plain paper copier (NP-400, mfd. by Canon K.K.) to effect successive copying of 500 sheets. As a result, stable and extremely distinct images free of fog were obtained. Thus, as shown in FIG. 1, their reflection densities were 1.42 on the first sheet, 1.39 on 20th sheet, 1.39 on 50th sheet, 1.40 on 100th sheet, and 1.40 on 500th sheet, indicating that no falling in image density occurred in the initial copying stage, the reflection densities were about 1.4 all over. In addition, even under environmental conditions of high temperature—high humidity (32.5° C. and 90%) and low temperature—low humidity (15° C. and 10%), the above developer of the present invention exhibited developing characteristics as good as those under normal temperature—normal humidity conditions.

EXAMPLES 2 TO 6

Respective developers were prepared in the same manner as in Example 1, except for the use of cerium oxide particles shown in the following Table 1. The results of the image forming tests conducted in the same manner as in Example 1 are shown in Table 2 appearing hereinafter.

TABLE 1

| Example | Cerium oxide particles | Volume average particle size (μm) | Heating loss at 100° C. after humidification (wt. %) | Specific surface area by BET method ($m^2/g$) |
|---|---|---|---|---|
| 2 | B | 2.12 | 0.15 | 9.6 |
| 3 | C | 2.86 | 0.03 | 1.8 |
| 4 | D | 2.12 | 0.08 | 3.5 |
| 5 | E | 2.41 | 0.04 | 1.7 |
| 6 | F | 2.17 | 0.04 | 2.1 |

EXAMPLE 7

A developer was prepared in the same manner as in Example 1, except for the use of 0.4 wt. part of hydrophobic silica having a hydrophobicity of about 50 and an average primary particle size of 0.016 micron. The results of the image forming test are shown in Table 2.

EXAMPLE 8

A developer was prepared in the same manner as in Example 1, except for the use of 100 wt. parts of styrene/2-ethylhexyl acrylate copolymer (weight ratio=7:2, Mw=243,000) as a binder resin. The results of the image forming test are shown in Table 2.

EXAMPLE 9

A developer was prepared in the same manner as in Example 1, except for the use of 100 parts of a styrene/n-butyl acrylate/monobutyl maleate terpolymer (weight ratio=70:25:5, Mw=420,000) as a binder resin. The results of the picture forming test are shown in Table 2.

EXAMPLE 10

A developer was prepared in the same manner as in Example 1, except for the use of 2 wt. parts of chromiumdialkylsalicylic alkylsalicylic acid complex (Bontron E-81) as a charge controller. The results of the image forming test are shown in Table 2.

COMPARATIVE EXAMPLE 1

A developer was prepared by mixing 100 wt. parts of the magnetic toner prepared in Example 1 with 0.4 wt. part of hydrophobic silica having a hydrophobicity of about 65 and an average primary particle size of 0.007 micron without using cerium oxide particles, and the image forming test was conducted in the same manner as in Example 1. As shown in FIG. 1, the reflection densities were as low as 1.09 on a first sheet, 0.90 on a 20th sheet, 0.71 on a 50th sheet, 0.73 on a 100th sheet and 1.22 on a 500th sheet, and a falling in image density was observed.

COMPARATIVE EXAMPLE 2

A developer was prepared by blending 100 wt. parts of the magnetic toner prepared in Example 1 with 0.4 wt. part of a silica with no hydrophobicity modification and having a hydrophobicity of 0 and an average particle size of 0.016 micron, and 1 wt. part of cerium oxide particles containing 63.2 wt. % of $CeO_2$ and having a volume-average particle size of 3.25 microns as measured by an Elzone counter, a heating loss of 2.3 wt. % on heating at 100° C. after humidification, and a specific surface area of 39.0 $m^2/g$ (outside the defined range in the present invention) as measured by the BET method. As apparent from FIG. 1, a significant falling in image density was observed at the points of 50th to 100th copied sheets.

COMPARATIVE EXAMPLE 3

A developer was prepared in the same manner as in Example 1, except for the use of 1 wt. part of cerium oxide particles containing 53 wt. % of $CeO_2$ and having a volume average particle size of 1.64 micron as measured by an Elzone counter, a heating loss of 1.08 wt. % (out of the defined range in the present invention) on heating at 100° C. after humidification, and a specific surface area of 8.1 $m^2/g$ as measured by the BET method. The results of the copying test are shown in Table 2.

COMPARATIVE EXAMPLE 4

A developer was prepared in the same manner as in Example 1, except for the use of 1 wt. part of cerium oxide particles containing 80 wt. % of $CeO_2$ and having a volume average particle size of 1.47 micron as measured by an Elzone counter, a heating loss of 1.50 wt. % on heating at 100° C. after humidification, and a specific surface area of 18.0 $m^2/g$ (outside the defined range in the present invention) as measured by the BET method. The results of the copying test are shown in Table 2.

COMPARATIVE EXAMPLE 5

A developer was prepared in the same manner as in Example 1, except for the use of 1 wt. part of cerium oxide particles containing 51.8 wt. % of $CeO_2$ and having a volume average particle size of 4.52 microns as measured by an Elzone counter, a heating loss of 0.14 wt. % on heating at 100° C. after humidification and a specific surface area of 1.8 $m^2/g$ as measured by the BET method. The results of the copying test are shown in Table 2.

COMPARATIVE EXAMPLE 6

A developer was prepared in the same manner as in Example 1, except for the use of 1 wt. part of cerium oxide particles containing 72.5 wt. % of $CeO_2$ and having a volume average particle size of 0.91 micron as measured by an Elzone counter, a heating loss of 0.08 wt. % on heating at 100° C. after humidification and a specific surface area of 9.5 $m^2/g$ as measured by the BET method. The results of the copying test are shown in Table 2.

COMPARATIVE EXAMPPLE 7

A developer was prepared in the same manner as in Example 1, except for the use of 0.4 wt. % of a silica with no hydrophobicity modification and having a hydrophobicity of 0 and an average particle size of 0.007 micron. The results of copying test are shown in Table 2.

TABLE 2

| Image characteristics | Image density (reflection density) 1st sheet | 20th sheet | 50th sheet | 100th sheet | 500th sheet | Fog | Clearness |
|---|---|---|---|---|---|---|---|
| Example | | | | | | | |
| 2 | 1.39 | 1.34 | 1.30 | 1.33 | 1.38 | o | o |
| 3 | 1.35 | 1.32 | 1.32 | 1.30 | 1.35 | o | o |
| 4 | 1.36 | 1.33 | 1.25 | 1.31 | 1.31 | oΔ | o |
| 5 | 1.31 | 1.29 | 1.35 | 1.26 | 1.34 | oΔ | oΔ |
| 6 | 1.39 | 1.34 | 1.34 | 1.33 | 1.27 | o | o |
| 7 | 1.33 | 1.29 | 1.27 | 1.29 | 1.30 | o | o |
| 8 | 1.28 | 1.25 | 1.25 | 1.27 | 1.30 | o | o |

TABLE 2-continued

| Image characteristics | Image density (reflection density) 1st sheet | 20th sheet | 50th sheet | 100th sheet | 500th sheet | Fog | Clearness |
|---|---|---|---|---|---|---|---|
| 9 | 1.38 | 1.33 | 1.30 | 1.34 | 1.35 | o | o |
| 10 | 1.26 | 1.22 | 1.25 | 1.28 | 1.30 | o | o |
| Comparative Example | | | | | | | |
| 2 | 1.30 | 1.14 | 0.99 | 1.00 | 1.22 | Δx | Δx |
| 3 | 1.28 | 1.15 | 1.07 | 1.22 | 1.29 | Δ | Δ |
| 4 | 1.20 | 1.03 | 0.85 | 0.99 | 1.14 | Δ | Δ |
| 5 | 1.26 | 1.10 | 0.92 | 0.95 | 1.16 | Δx | Δx |
| 6 | 1.10 | 0.94 | 0.85 | 0.98 | 0.99 | Δ | x |
| 7 | 1.35 | 1.13 | 0.98 | 1.10 | 1.25 | Δx | x |

o . . . Good
oΔ. . . Rather good
Δ. . . Rather bad
Δx . . . Considerably bad
x . . . Worst In Example 2 to 10, extremely clear images having no fog were obtained which were substantially free of initial falling in image density and stable in reflection density from the first sheet to the last sheet. On the other hand, in Comparative EXAMPLES 2 to 7, significant initial falling in image density was observed, and the reduction in reflection density of approximately 0.3 or more occurred in any case of from the first sheet to 50th sheet, and thus, only unclear images having remarkable and inferior resolving power as compared with those in Examples of the present invention were obtained. It will be understood from the above that the developer of the present invention is very effective.

EXAMPLE 11

| | |
|---|---|
| Styrene/n-butylmethacrylate copolymer (weight ratio of styrene to n-butylmethacrylate of 6:4; Mw = 210,000) | 100 wt. parts |
| Magnetite (volume-average particle size of 0.5μ) | 60 wt. parts |
| Low molecular weight polyethylene | 4 wt. parts |
| Zinc complex monoazo dye | 2 wt. parts |

The mixture having the above prescription was melt-kneaded, cooled and then pulverized and classified to give an insulating magnetic toner (an electric resistance of $10^{15}$ Ωcm) having a particle size of 5 to 20 microns (a volume-average particle size of 12 microns). Then, 100 wt. parts of the resulting insulating magnetic toner was mixed with 0.4 wt. parts of a hydrophobic silica having a hydrophobicity of about 65 and an average primary particle size of 0.007 micron and one part of cerium oxide particles containing 80 wt. % of $CeO_2$ (a volume average particle size of 2.74 microns as measured by an Elzone counter (available from Particle Data, Co., in U.S.A.); a heating loss of 0.14 wt. % on heating to 100° C. after humidification; and a BET specific surface area of 3.6 $m^2/g$ as measured by an automatic specific surface area measuring device (2200-type, available from Shimazu Seisakusho K.K.)) to prepare a developer.

Figure 2:
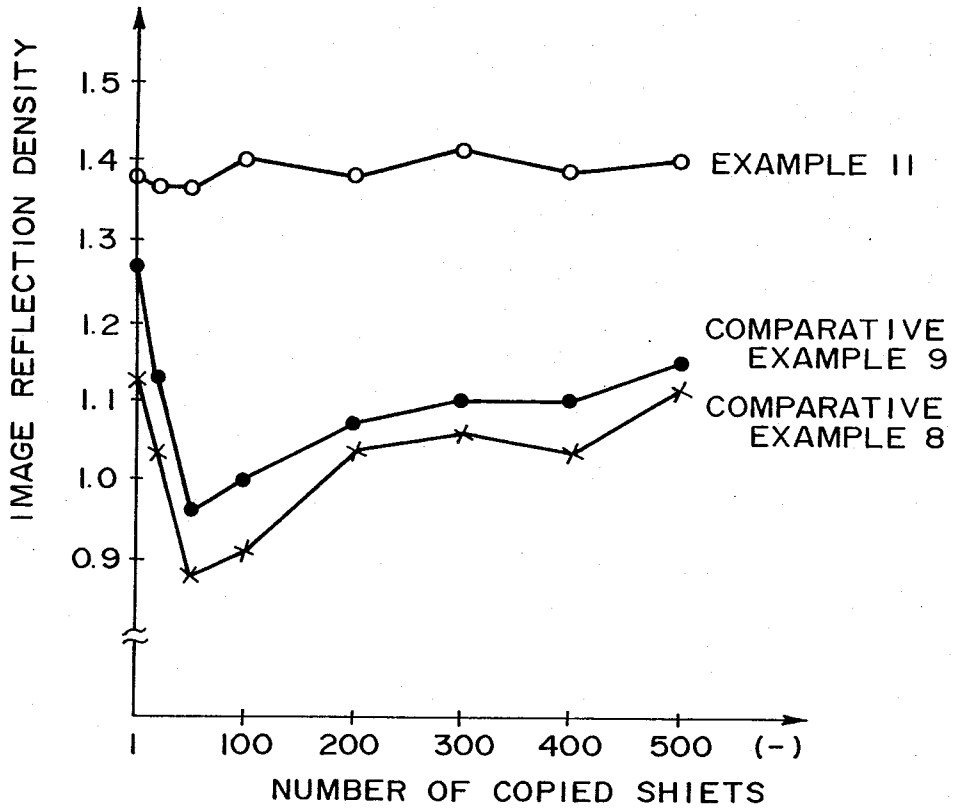

The developer was applied to a commercially available plain paper copier (NP-400 made by Canon K.K.) to effect successive copying of 500 sheets. As a result, stable and extremely distinct images free of fog were obtained. As shown in FIG. 2, their reflection densities were 1.38 on the first sheet, 1.37 on 20th sheet, 1.37 on 50th sheet, 1.40 on 100th sheet, and 1.40 on 500th sheet, indicating that no falling in image density occurred in the initial copying stage, the reflection densities were about 1.4 all over. In addition, even under environmental conditions of high temperature—high humidity (32.5° C. and 90%) and of low temperature—low humidity (15° C. and 10%), the above developer of the present invention exhibitcd developing characteristics as good as those under normal temperature—normal humidity conditions.

EXAMPLES 12 TO 16

Respective developers were prepared in the same manner as in Example 11, except for the use of cerium oxide particles shown in the following Table 3. The results of the image forming tests conducted in the same manner as in Example 1 are shown in Table 2.

EXAMPLE 17

A developer was prepared in the same manner as in Example 11, except for the use of 0.4 wt. part of hydrophobic silica having a hydrophobicity of about 50 and an average primary particle size of 0.016 micron. The results of the image forming test are shown in Table 3.

EXAMPLE 18

A developer was prepared in the same manner as in Example 11, except for the use of 100 wt. parts of styrene/2-methylphenyl methacrylate copolymer (weight ratio=6:4; Mw=260,000) as a binder resin. The results of the image forming test are shown in Table 3.

EXAMPLE 19

A developer was prepared in the same manner as in Example 11, except for the use of 100 parts of a styrene/n-butyl methacrylate/monobutyl maleate terpolymer (weight ratio=60:35:5; Mw=350,000) as a binder resin. The results of the image forming test are shown in Table 3.

EXAMPLE 20

A developer was prepared in the same manner as in Example 11, except for the use of 2 wt. parts of zinc alkylsalicylic acid complex as a charge controller. The results of the image forming test are shown in Table 3.

COMPARATIVE EXAMPLE 8

A developer was prepared by mixing 100 wt. parts of the magnetic toner prepared in Example 11 with 0.4 wt. part of hydrophobic silica having a hydrophobicity of about 65 and an average primary particle size of 0.007 micron, and the image forming test was conducted in the same manner as in Example 11.

As shown in FIG. 2, the reflection densities were as low as 1.13 on a first copied sheet, 1.30 on a 20th copied sheet, 0.88 on a 50th copied sheet, 0.91 on a 100th copied sheet and 1.11 on a 500th copied sheet, and a falling in image density was observed.

COMPARATIVE EXAMPLE 9

A developer was prepared by blending 100 wt. parts of the magnetic toner prepared in Example 11 with 0.4 wt. part of a silica with no hydrophobicity modification having a hydrophobicity of 0 and an average particle size of 0.016 micron and 1 wt. part of cerium oxide particles containing 63.2 wt. % of $CeO_2$ and having a volume average particle size of 3.25 microns as measured by an Elzone counter, a heating loss of 2.3 wt. % on heating at 100° C. after humidification and a specific surface area of 39.0 $m^2/g$ (outside the defined range in the present invention) as measured by the BET method. As apparent from a graph illustrated in FIG. 2, a significant falling in image density was observed at the time of 50th to 100th copied sheets.

COMPARATIVE EXAMPLE 10

A developer was prepared in the same manner as in Example 11, except for the use of 1 wt. part of cerium oxide particles containing 53 wt. % of $CeO_2$ and having a volume average particle size of 1.64 micron as measured by an Elzone counter, a heating loss of 1.08 wt. % (outside the defined range in the present invention) on heating at 100° C. after humidification and a specific surface area of 8.1 $m^2/g$ as measured by the BET method. The results of the copying test are shown in Table 3.

COMPARATIVE EXAMPLE 11

A developer was prepared in the same manner as in Example 11, except for the use of 1 wt. part of cerium oxide particles containing 80 wt. % of $CeO_2$ and having a volume average particle size of 1.47 micron as measured by an Elzone counter, a heating loss of 1.50 wt. % on heating at 100° C. after humidification and a specific surface area of 18.0 $m^2/g$ (outside the defined range in the present invention) as measured by the BET method. The results of the copying test are shown in Table 3.

COMPARATIVE EXAMPLE 12

A developer was prepared in the same manner as in Example 11, except for the use of 1 wt. part of cerium oxide particles containing 51.8 wt. % of $CeO_2$ and having a volume average particle size of 4.52 microns as measured by an Elzone counter, a heating loss of 0.14 wt. % on heating at 100° C. after humidification and a specific surface area of 1.8 $m^2/g$ as measured by the BTT method. The results of the copying test are shown in Table 3.

COMPARATIVE EXAMPLE 13

A developer was prepared in the same manner as in Example 11, except for the use of 1 wt. part of cerium oxide particles containing 72.5 wt. % of $CeO_2$ and having a volume average particle size of 0.91 micron as measured by an Elzone counter, a heating loss of 0.08 wt. % on heating at 100° C. after humidification and a specific surface area of 9.5 $m^2/g$ as measured by the BET method. The results of the copying test are shown in Table 3.

COMPARATIVE EXAMPLE 14

A developer was prepared in the same manner as in Example 11, except for the use of a silica with no hydrophobicity modification and having a hydrophobicity of 0 and an average particle size of 0.007 micron. The results of the copying test are shown in Table 3.

TABLE 3

| Image characteristics | Image density (reflection density) 1st sheet | 20th sheet | 50th sheet | 100th sheet | 500th sheet | Fog | Clearness |
|---|---|---|---|---|---|---|---|
| Example | | | | | | | |
| 12 | 1.38 | 1.35 | 1.35 | 1.33 | 1.36 | o | o |
| 13 | 1.34 | 1.32 | 1.31 | 1.28 | 1.33 | o | o |
| 14 | 1.35 | 1.33 | 1.27 | 1.30 | 1.29 | oΔ | o |
| 15 | 1.31 | 1.28 | 1.33 | 1.25 | 1.32 | oΔ | oΔ |
| 16 | 1.38 | 1.32 | 1.34 | 1.35 | 1.29 | o | o |
| 17 | 1.30 | 1.29 | 1.26 | 1.25 | 1.29 | o | o |

TABLE 3-continued

| Image characteristics | Image density (reflection density) 1st sheet | 20th sheet | 50th sheet | 100th sheet | 500th sheet | Fog | Clearness |
|---|---|---|---|---|---|---|---|
| 18 | 1.29 | 1.24 | 1.25 | 1.28 | 1.31 | o | o |
| 19 | 1.37 | 1.33 | 1.29 | 1.32 | 1.36 | o | o |
| 20 | 1.26 | 1.23 | 1.27 | 1.24 | 1.29 | o | o |
| Comparative Example | | | | | | | |
| 9 | 1.27 | 1.13 | 0.96 | 1.00 | 1.15 | Δx | Δx |
| 10 | 1.29 | 1.15 | 1.03 | 1.19 | 1.28 | Δ | Δ |
| 11 | 1.23 | 1.01 | 0.90 | 0.97 | 1.12 | Δ | Δ |
| 12 | 1.26 | 1.15 | 0.95 | 0.92 | 1.13 | Δx | Δx |
| 13 | 1.13 | 0.97 | 0.85 | 0.89 | 0.99 | Δ | x |
| 14 | 1.31 | 1.13 | 0.96 | 1.07 | 1.19 | Δx | x |

In Examples 12 to 20, extremely clear images having no fog were obtained which were substantially free of initial falling in image density and stable in reflection density from the initial sheet to the last sheet. On the other hand, in Comparative Examples 9 to 14, significant initial falling in image density was observed, and the reduction in reflecting density of approximately 0.3 or more occurred in any case of from the first sheet to 50th sheet, and thus, only unclear images having remarkable fog and inferior resolving power as compared with those in Examples of the present invention were obtained. The effectiveness the developer of the present invention will be understood from the above results.

What is claimed is:

1. A magnetic dry one-component developer, comprising:

negatively chargeable insulating magnetic toner particles containing, at least a binder resin, a magnetic substance and an organo-chromium or -zinc complex having a negative chargeability controlling property;

cerium oxide particles containing $CeO_2$ as a predominant component and having a volume average particle size of 1.0 to 4.0 microns, a heating loss of 0.5 wt. % or less on heating up to 100° C. and a BET specific surface area of 15 $m^2/g$ or less as measured by the nitrogen absorption method; and hydrophobicity-imparted negatively chargeable silicon oxide particulates having a methanolic hydrophobicity of 40% or more.

2. A developer according to claim 1, wherein the cerium oxide particles are incorporated in an amount of 0.1 to 5 wt. parts per 100 wt. parts of the negatively chargeable insulating magnetic toner particles.

3. A developer according to claim 1, wherein the hydrophobicity-imparted negatively chargeable silicon oxide particulates are incorporated in an amount of 0.01 to 3 wt. parts per 100 wt. parts of the negatively chargeable insulating magnetic toner particles.

4. A developer according to claim 1, wherein the organo-chromium complex is added in an amount of 0.1 to 10 wt. % based on the weight of the binder resin.

5. A developer according to claim 4, wherein the organo-chromium complex is a chromium complex salttype monoazo dye, chromium complex of salicylic acid, chromium complex of an alkylsalicylic acid or chromium complex of a dialkylsalicylic acid.

6. A developer according to claim 1, wherein the organo-zinc complex is added in an amount of 0.1 to 10 wt. % based on the weight of the binder resin.

7. A developer according to claim 1, wherein the organo-zinc complex is a zinc acetylacetone complex, a zinc EDTA complex or a zinc picolinic acid complex.

8. A developer according to claim 1, wherein the magnetic toner has a triboelectric chargeability.

9. A developer according to claim 8, wherein the magnetic toner has an electric resistance of $10^{10}$ Ωcm or more.

10. A developer according to claim 9, wherein the magnetic toner contains 30 to 100 wt. parts of the magnetic substance per 100 wt. parts of the binder resin.

11. A developer according to claim 1, wherein the magnetic toner has a volume average particle size of 5 to 30 microns.

12. A developer according to claim 1, wherein the binder resin is a styrene resin, a styrene/acrylic ester resin, a styrene/methacrylic ester resin or a polyester resin.

13. A developer according to claim 1, wherein the magnetic toner particles have a triboelectric chargeability and an electric resistance of $10^{13}$ Ωcm or more, the cerium oxide particles are incorporated in an amount of 0.1 to 5 wt. parts per 100 wt. parts of said toner particles, and the silicon oxide particles having a methanolic hydrophobicity of 40% or more are incorporated in an amount of 0.01 to 3 wt parts per 100 wt. parts of said toner particles.

14. A developer according to claim 13, wherein the toner particles contain 0.5 to 5 wt. % of the organo-chromium complex based on the weight of the binder resin, and the organo-chromium complex comprises a compound selected from the group consisting of a chromium complex salt-type monoazo dye, chromium complex of salicylic acid, chromium complex of an alkylsalicylic acid and chromium complex of a dialkylsalicylic acid.

15. A developer according to claim 14, wherein the binder resin comprises a resin selected from the group consisting of a styrene resin, a styrene/acrylic ester resin, a styrene/methacrylic ester resin and a polyester resin.

16. A developer according to claim 13, wherein the toner particles contain 0.5 to 5 wt. % of the organo-zinc complex based on the weight of the binder resin, and the organo-zinc complex comprises a compound selected from the group consisting of a zinc complex salt-type monoazo dye, and zinc complex of salicylic acid and an alkylsalicylic acid.

17. A developer according to claim 16, wherein the binder resin comprises a resin selected from the group consisting of a styrene resin, a styrene/acrylic ester resin, a styrene/methacrylic ester resin and a polyester resin.

18. A developer according to claim 13, wherein the cerium oxide particles have a volume average particles size of 1.5 to 3.5 microns.

* * * * *

UNITED STATES PATENT AND TRADEMARK OFFICE

CERTIFICATE OF CORRECTION

PATENT NO. : 4,824,752

DATED : April 25, 1989

INVENTOR(S) : SATOSHI YASUDA, ET AL.

It is certified that error appears in the above-identified patent and that said Letters Patent is hereby corrected as shown below:

SHEET 1

FIG. 1, "SHIETS" should read --SHEETS--.

SHEET 2

FIG. 2, "SHIETS" should read --SHEETS--.

COLUMN 15

Line 44, "absorption" should read --adsorption--.
Line 62, "salttype" should read --salt-type--.

COLUMN 16

Line 52, "and" (first occurrence) should read --a--.
Line 60, "particles" (second occurrence) should read --particle--.

Signed and Sealed this

Thirteenth Day of March, 1990

*Attest:*

JEFFREY M. SAMUELS

*Attesting Officer*

*Acting Commissioner of Patents and Trademarks*